US010777033B2

(12) United States Patent
Kim et al.

(10) Patent No.: US 10,777,033 B2
(45) Date of Patent: Sep. 15, 2020

(54) PAPER SHEET REDIRECTING UNIT AND PAPER SHEET PROCESSING APPARATUS USING THE SAME

(71) Applicant: HITACHI TERMINAL SOLUTIONS KOREA CO., LTD., Gyeonggi-do (KR)

(72) Inventors: Sung-Chan Kim, Gyeonggi-do (KR); Bong-Seob Oh, Gyeonggi-do (KR); Seon-Ho Kim, Gyeonggi-do (KR)

(73) Assignee: HITACHI TERMINAL SOLUTIONS KOREA CO., LTD., Gyeonggi-Do (KR)

( * ) Notice: Subject to any disclaimer, the term of this patent is extended or adjusted under 35 U.S.C. 154(b) by 223 days.

(21) Appl. No.: 15/573,419

(22) PCT Filed: May 21, 2015

(86) PCT No.: PCT/KR2015/005100
§ 371 (c)(1),
(2) Date: Nov. 10, 2017

(87) PCT Pub. No.: WO2016/182110
PCT Pub. Date: Nov. 17, 2016

(65) Prior Publication Data

US 2018/0108202 A1 Apr. 19, 2018

(30) Foreign Application Priority Data

May 12, 2015 (KR) ..... 10-2015-0065965

(51) Int. Cl.
*G07D 11/50* (2019.01)
*G07D 11/18* (2019.01)
(Continued)

(52) U.S. Cl.
CPC ..... *G07D 11/50* (2019.01); *B07C 5/34* (2013.01); *B65H 29/12* (2013.01); *B65H 29/40* (2013.01);
(Continued)

(58) Field of Classification Search
CPC ..... B07C 5/34; G07D 11/10; G07D 11/18; G07D 11/22; G07D 11/50; G07D 11/16;
(Continued)

(56) References Cited

U.S. PATENT DOCUMENTS 5,382,013 A * 1/1995 Walsh ..... B65H 29/12 271/186
6,474,638 B1 * 11/2002 Mylaeus ..... B65H 15/00 271/184
(Continued)

FOREIGN PATENT DOCUMENTS

JP H11120406 4/1999
JP 2003054811 2/2003
(Continued)

*Primary Examiner* — Charles A Fox
*Assistant Examiner* — Kalyanavenkateshware Kumar
(74) *Attorney, Agent, or Firm* — IPLA P.A.; James E. Bame

(57) ABSTRACT

The paper sheet redirecting unit (60) for changing a direction of a paper sheet configured to support one side of the paper sheet and change the direction of the paper sheet while transferring the paper sheet; and an other-side redirecting member (62) configured to support the other side of the paper sheet in a state of coming in contact with the one-side redirecting member (61) and to change the direction of the paper sheet while transferring the paper sheet, wherein if a power is transmitted to the one-side redirecting member (61) or the other-side redirecting member (62), the one-side redirecting member (61) and the other-side redirecting member (62) are operated in company with each other, thereby discharging the paper sheet while changing the direction of
(Continued)

the paper sheet to be inputted between the one-side redirecting member (61) and the other-side redirecting member (62).

12 Claims, 9 Drawing Sheets

(51) Int. Cl.

| | |
|---|---|
| ***G07D 11/22*** | (2019.01) |
| ***B65H 31/02*** | (2006.01) |
| ***B65H 29/12*** | (2006.01) |
| ***B65H 29/52*** | (2006.01) |
| ***B65H 29/40*** | (2006.01) |
| ***B65H 31/24*** | (2006.01) |
| ***G07D 11/10*** | (2019.01) |
| ***B07C 5/34*** | (2006.01) |

(52) U.S. Cl.
CPC ..... *B65H 29/52* (2013.01); *B65H 31/02* (2013.01); *B65H 31/24* (2013.01); *G07D 11/10* (2019.01); *G07D 11/18* (2019.01); *G07D 11/22* (2019.01); *B65H 2301/33212* (2013.01); *B65H 2301/4214* (2013.01); *B65H 2404/2561* (2013.01); *B65H 2408/11* (2013.01); *B65H 2701/1912* (2013.01)

(58) Field of Classification Search
CPC ..... G07D 11/175; B65H 29/12; B65H 29/40; B65H 29/52; B65H 31/02; B65H 31/24; B65H 2301/4214; B65H 2301/33212; B65H 2404/2561; B65H 2408/11; B65H 2701/1912
See application file for complete search history.

(56) References Cited

U.S. PATENT DOCUMENTS

| | | | | |
|---|---|---|---|---|
| 2008/0197183 | A1* | 8/2008 | Haney | B65H 5/025 232/1 D |
| 2010/0236892 | A1* | 9/2010 | Jones | B65H 15/00 194/206 |
| 2011/0215034 | A1* | 9/2011 | Mennie | G07D 11/00 209/534 |
| 2016/0122148 | A1* | 5/2016 | Westcott | B65H 31/24 358/488 |
| 2017/0260016 | A1* | 9/2017 | Tan | B65H 9/16 |

FOREIGN PATENT DOCUMENTS

| | | |
|---|---|---|
| KR | 2020100003187 | 3/2010 |
| KR | 201174664 | 4/2011 |
| KR | 101467704 | 12/2014 |
| WO | WO2010/110630 | 9/2010 |

* cited by examiner

PAPER SHEET REDIRECTING UNIT AND PAPER SHEET PROCESSING APPARATUS USING THE SAME

CROSS REFERENCE

The present application claims the benefit of Korean Patent Application No. 10-2015-0065965 filed in the Korean Intellectual Property Office on May 12, 2015, the entire contents of which are incorporated herein by reference.

BACKGROUND

The present invention relates to a paper sheet redirecting unit capable of changing a direction of paper sheets to be fed, and sorting and discharging the paper sheets in different directions according to discrimination, and a paper sheet processing apparatus using the same.

In general, a paper sheet processing apparatus is designed to automatically count the number of paper sheets by a mechanical device, as well as valuable papers, such as checks.

Such a paper sheet processing apparatus 100 includes, as illustrated in FIG. 1, a housing 110 having an inner space to form its appearance. The housing 110 has an inlet hopper 111 formed at one side thereof which communicates with the inner space to feed a paper sheet to the inner space, a first hopper 191 formed at the other side thereof, from which the paper sheet fed from the inlet hopper 111 is discharged, and a second hopper 192 spaced apart from the first hopper 191, from which a different type of paper sheet from the paper sheet discharged from the first hopper 191. Also, the paper sheet processing apparatus includes a display 170 to display the type of the received paper sheet and the number of the counted paper sheets.

A lower portion of the inlet hopper 111 is provided with rollers to transfer the paper sheets to the inside of the housing 110. If the rollers turn, the paper sheets stacked on the inlet hopper 111 are transferred in order, and then are separately discharged from the second hopper 192 and the first hopper 191.

However, since the first hopper 191 and the second hopper 192 are placed in a vertical direction, the above counting machine can sort the paper sheet into only two types. If other hopper is installed to an upper portion or a lower portion, the height of the housing 110 is increased, which is inconvenient to count the paper sheets.

Also, since the first hopper 191 and the second hopper 192 face forward, the paper sheets raise dust in front of the machine, which may be harmful to a user.

A related background technology of the present invention is disclosed in Korean Utility Model No. 20-0452857 (registered on Mar. 16, 2011).

SUMMARY OF THE INVENTION

An object of the present invention is to provide a paper sheet redirecting unit capable of changing a direction of paper sheets to be fed, and sorting and discharging the paper sheets in different directions according to discrimination, and a paper sheet processing apparatus using the same.

According to one aspect of the present invention, there is provided a paper sheet redirecting unit for changing a direction of a paper sheet to be transferred, the paper sheet redirecting unit including: a one-side redirecting member configured to support one side of the paper sheet and change the direction of the paper sheet while transferring the paper sheet; and an other-side redirecting member configured to support the other side of the paper sheet in a state of coming in contact with the one-side redirecting member and to change the direction of the paper sheet while transferring the paper sheet, wherein if a power is transmitted to the one-side redirecting member or the other-side redirecting member, the one-side redirecting member and the other-side redirecting member are operated in company with each other, thereby discharging the paper sheet while changing the direction of the paper sheet to be inputted between the one-side redirecting member and the other-side redirecting member.

According to another aspect of the present invention, there is provided a paper sheet processing apparatus including: a housing equipped with the paper sheet redirecting unit; a sensing member configured to detect a paper sheet fed into an inner space of the housing; and a first sorting member configured to sort the paper sheet so that the paper sheet detected by the sensing member is guided to a paper sheet redirecting unit or in a direction from paper sheet redirecting unit.

With the above configuration, the present invention has an advantage in which since the direction of the paper sheet to be transferred by the paper sheet redirecting unit is changed, the direction of the paper sheet can be correctly changed.

Also, since the present invention detects the paper sheet transferred into the inner space of the housing, and sorts and discharges the paper sheets to both sides of the housing according to the detection, it is possible to sort the paper sheets according to the detection, and also to minimize the height of the housing.

In addition, since the detected paper sheets are sorted and discharged to both sides of the housing, it is possible to dust coming from the paper sheet to be discharged from being dispersed in front of the housing.

DETAILED DESCRIPTION OF THE INVENTION

Hereinafter, the present invention will be described in detail with reference to the accompanying drawings.

Figure 1:
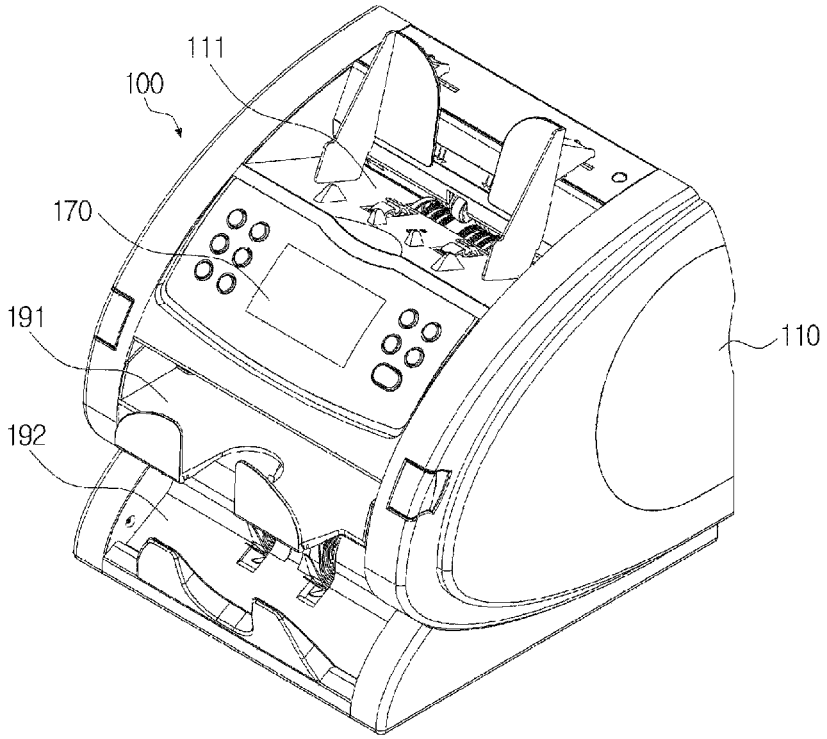
FIG. 1 is a perspective view of a conventional paper sheet counter.
Figure 2:
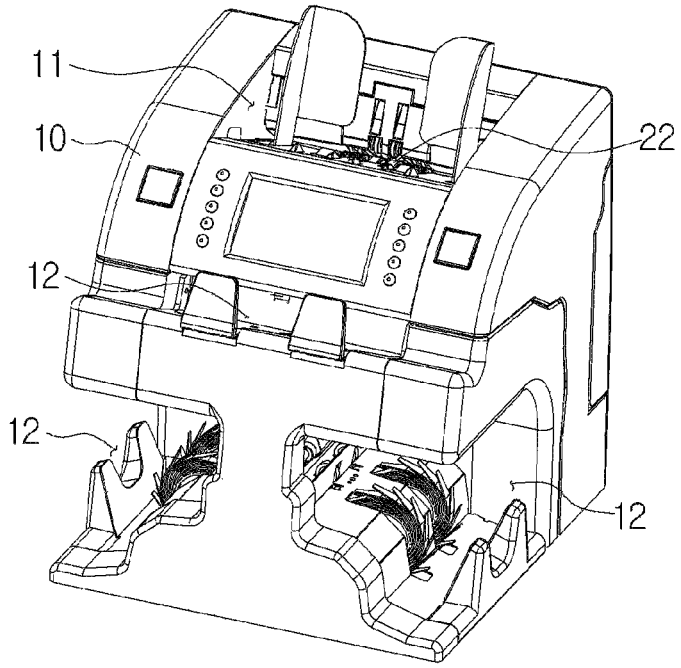
FIG. 2 is a perspective view illustrating a paper sheet processing apparatus according to one embodiment of the present invention.
Figure 3:
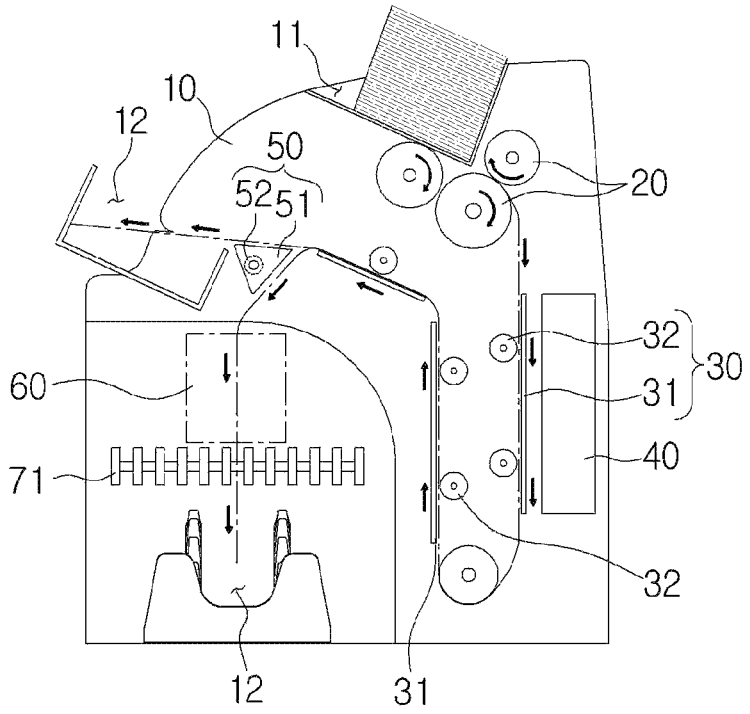
FIG. 3 is a view illustrating a transport path of a paper sheet in FIG. 2.
Figure 4:
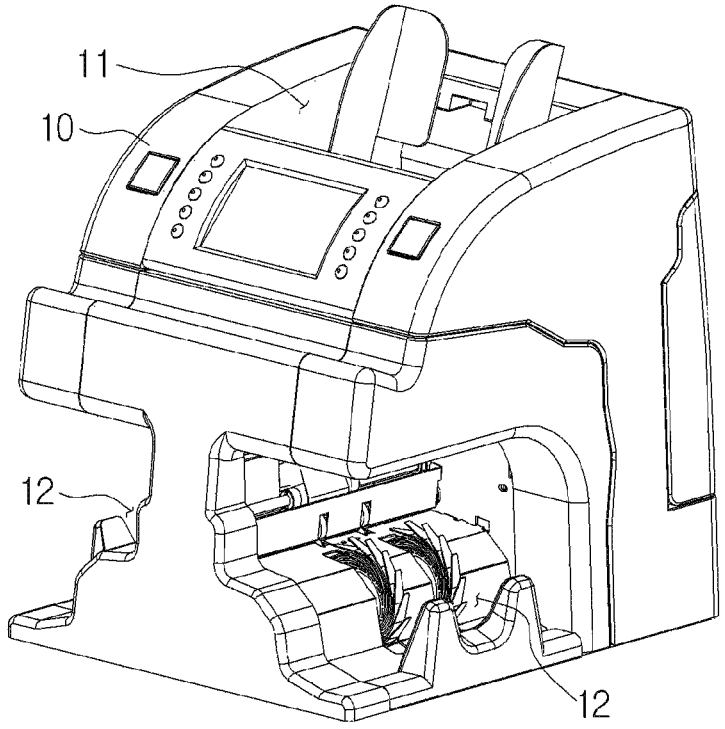
FIG. 4 is a perspective view illustrating a paper sheet processing apparatus according to another embodiment of the present invention.
Figure 5:
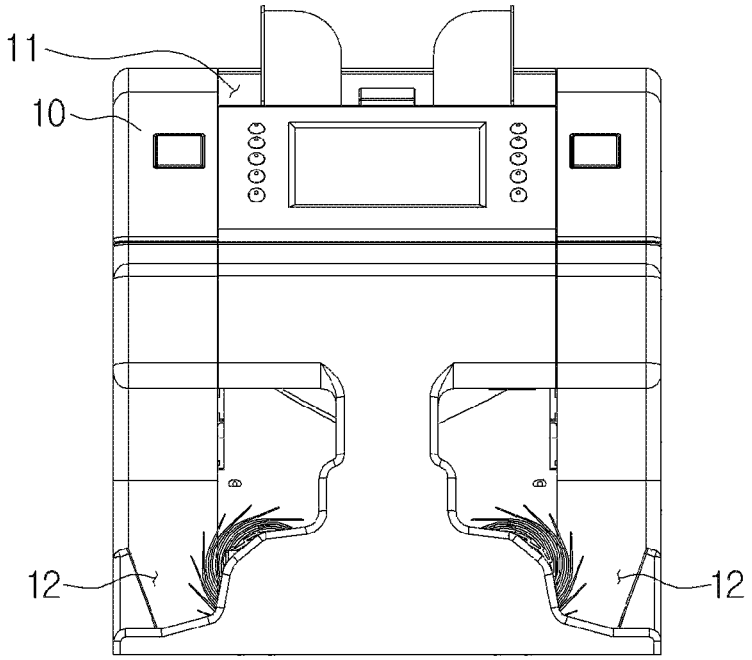
FIG. 5 is a front view of the paper sheet processing apparatus in FIG. 4.
Figure 6:
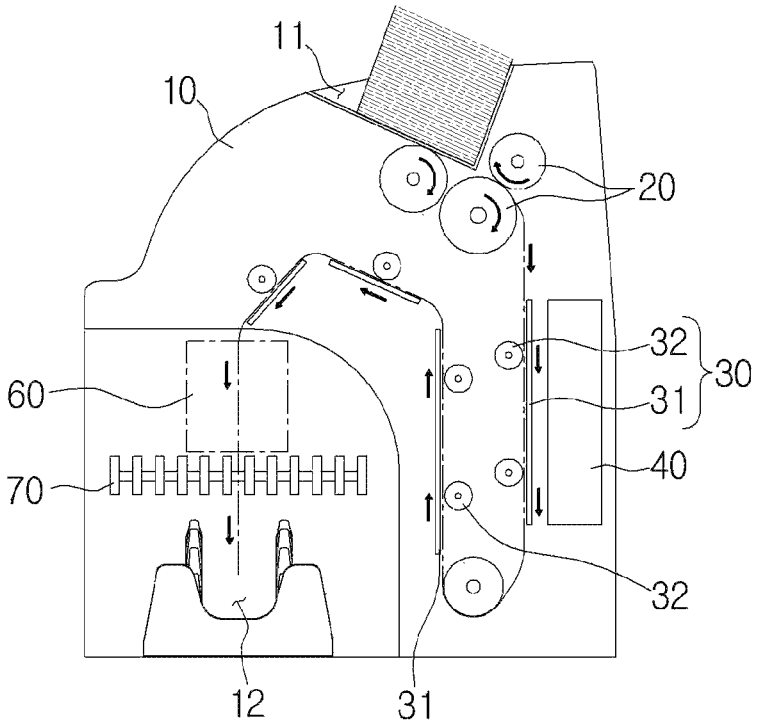
FIG. 6 is a view illustrating a transport path of a paper sheet in FIG. 4.
Figure 7:
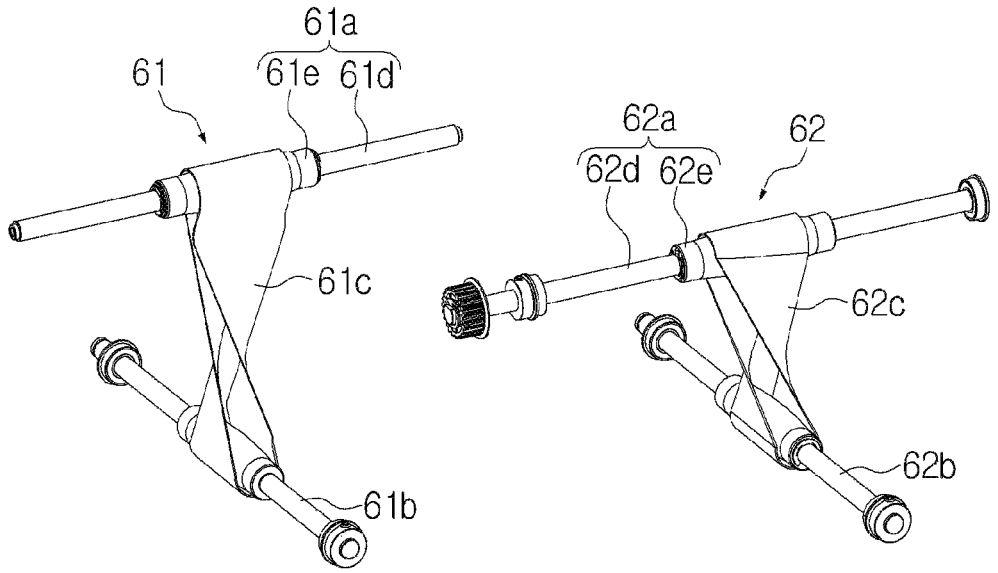
FIG. 7 is an exploded perspective view illustrating a disassembled state of a paper sheet redirecting unit according to one embodiment of the present invention.

As illustrated in FIGS. 2 and 3, a paper sheet processing apparatus according to a preferred embodiment of the present invention includes a housing 10, a feeding member 20, a transport member 30, a sensing member 40, a first sorting member 50, a paper sheet redirecting unit 60, and a second sorting member 70.

First, a paper sheet includes a banknote, a check, a barcode voucher, a marketable security, a gift certificate, and so forth.

The housing 10 with an inner space has an inlet hopper 11 and a discharge hopper 12 which communicates with the inlet hopper 11.

As illustrated in FIGS. 2 to 6, the inlet hopper 11 may be formed on the upper portion of the housing 10, on which paper sheets to be fed to the inner space are stacked on the inlet hopper. Since the inlet hopper 11 is formed on the upper portion of the housing 10, a user can conveniently use the paper sheets.

The discharge hopper 12 may be formed at a lower portion of the housing 10, on which the paper sheets to be discharged outwardly are stacked. In case where two discharge hoppers 12 are provided, as illustrated in FIGS. 2 and 3, the discharge hoppers may be separately provided on both sides of the housing 10. In case where three discharge hoppers are provided, as illustrated in FIGS. 3 to 6, one discharge hopper may be provided on a front or rear surface of the housing 10, and two discharge hoppers may be provided on both sides. In this instance, in the case where the discharge hoppers 12 are provided on both sides, dust coming from the paper sheets to be discharged from the discharge hoppers 12 is discharged toward both sides of the housing 10, thereby preventing the dust from scattering toward the user positioned in front of the housing 10. That is, it is possible to minimize the damage of the scattered dust.

The feeding members 20 are provided to the inlet hopper 11 of the housing to feed the paper sheets into the inner space through the inlet hopper 11. A plurality of feeding members 20 may be respectively installed to one side of the inlet hopper 11, and may be rotated by a rotating force inputted from the exterior to feed the paper sheets by a frictional force. Accordingly, if rollers are rotated, the paper sheets can be sequentially fed into the inner space of the housing 10.

The transport member 30 is configured to transport the paper sheets to be fed by the feeding members 20 to the inner space of the housing 10, and has guide plates 31 and transport rollers 32.

A plurality of guide plates 31 are installed from the inlet hopper 11 to the discharge hopper 12 in the inner space of the housing 10 in the state in which the guide plates are connected to each other, thereby guiding the transport of the paper sheets.

A plurality of transport rollers 32 are rotated by a driving member (not illustrated) to forcibly transfer the paper sheets guided by the guide plates 31. The driving member may be an electric motor which is axially engaged to one transport roller 32, or may be an electric motor which is axially engaged to the transport roller 32 to rotate any one of transport rollers 32 and a belt (not illustrated) interposed between the transport rollers 32.

Since the transport roller 32 is rotated by operation of the driving member, the paper sheets can be transferred to the discharge hopper 12 provided on the front side of the housing 10 along the guide plates 31.

The sensing member 40 is configured to detect the paper sheets fed into the inner space of the housing 10, and may be provided to one or both sides of the transport member 30 to detect a counterfeit bill, a type or a damaged banknote among the paper sheets transferred by the transport member 30. The sensing member 40 detects an ink color, a magnetic property contained in the ink, a material of the paper sheet, a thickness of the paper sheet, a secret code of the paper sheet, and so forth, and also detects a series number and type of the paper sheet by scanning one or both sides of the paper sheet. In addition, the sensing member 40 can scan the paper sheet to detect the extent of the damage, such as tear, cut, or wear, in the paper sheet.

The sensing member 40 can discriminate different types of paper sheets, such as the won, the dollar, the yen, or the like, and also can detect the counterfeit bill or the damaged banknote, as well as a denomination of the paper sheet.

The paper sheets detected by the sensing member 40 can be discharged and stacked on the respective discharge hoppers 12 according to the counterfeit bill, the type or the damaged banknote.

As illustrated in FIGS. 3, 6, and 12 to 14, the first sorting member 50 sorts the paper sheets to guide the paper sheets detected by the sensing member 40 or to guide the paper sheets in different directions. The first sorting member 50 can sort the paper sheets transferred by the transport member 30 in the state in which the first sorting member is placed adjacent to the transport member 30.

The first sorting member 50 has a first sorter 51 and a first sorter driving member 52.

The first sorter 51 is formed in a triangular shape with a sharp corner to sort the paper sheets transferred by the transport member 30 in different directions, and both sides of the first sorter have a flat guide surface or a recessed guide surface.

The first sorter 51 is rotatably installed to the front side of the housing 10 at a position between the discharge hopper 12 and the transport member 30 provided on the front side of the housing 10. A plurality of first sorters 51 are provided at regular intervals to minimize air resistance on the guide surface in the process of sorting the paper sheets.

Specifically, since a wind produced from the guide surface when the first sorter 51 rotates in a clockwise or counterclockwise direction disperses, which can minimize the effect of the wind on the paper sheets.

If the first sorters 51 rotate in an upward direction and then the sharp corners of the first sorters face upwardly, the paper sheets transferred by the transport member 30 are guided downwardly by the guide surfaces. If the first sorters 51 rotate in a downward direction and then the sharp corners of the first sorters face downwardly, the paper sheets transferred by the transport member 30 are guided upwardly by other guide surfaces. Specifically, the paper sheets to be transferred upwardly are guided to the discharge hopper 12 provided on the front side of the housing 10, and the paper sheets to be transferred downwardly are guided to the paper sheet redirecting unit 60 positioned at the lower portion of the housing 10.

The first sorter driving member 52 may be a stepping motor or a solenoid which can rotate the first sorter 51 in a clockwise or counterclockwise direction. Accordingly, as the first sorter 51 is rotated upwardly or downwardly at a desired angle by the first sorter driving member 52, the paper sheets to be transferred along the guide plates 31 can be guided in the upward or downward direction.

As illustrated in FIGS. 7 to 11, the paper sheet redirecting unit 60 is configured to change a direction of the paper sheet to be transferred and discharge it. The paper sheet redirecting unit 60 has a one-side redirecting member 61 configured to support one side of the paper sheet and change the direction of the paper sheet while transferring the paper sheet, and an other-side redirecting member 62 configured to support the other side of the paper sheet in a state of coming in contact with the one-side redirecting member 61 and to change the direction of the paper sheet while transferring the paper sheet.

If the power is transmitted to the one-side redirecting member 61 or the other-side redirecting member 62, the one-side redirecting member 61 or the other-side redirecting member 62 work together to change the direction of the paper sheet to be fed between the one-side redirecting member 61 or the other-side redirecting member 62 and then discharge the paper sheet. Specifically, the paper sheet redirecting unit 60 is positioned adjacent to the first sorting member 50 to shift the left and right directions of the sorted paper sheet and then transfer the paper sheet to the lower portion of the housing 10.

The one-side redirecting member 61 has a first one-side rotating member 61*a* rotatably provided, a second one-side rotating member 61*b* which is spaced apart from the first one-side rotating member 61*a* at a desired interval and is rotatably provided in a state of being offset from the first one-side rotating member 61*a* in a different direction, and a third one-side transmission member 61*c* which is interposed between the first one-side rotating member 61*a* and the second one-side rotating member 61*b* and comes into contact with one side of the paper sheet in a rotatable state in which one end and the other end are offset from each other.

The first one-side rotating member 61*a* and the second one-side rotating member 61*b* may be rollers, and the third one-side transmission member 61*c* may be a belt. Accordingly, if the power is transmitted to the first one-side rotating member 61*a* or the second one-side rotating member 61*b*, the third one-side transmission member 61*c* may be rotated.

The other-side redirecting member 62 has a first other-side rotating member 62*a* rotatably provided to correspond to the first one-side rotating member 61*a*, a second other-side rotating member 62*b* which is spaced apart from the first other-side rotating member 62*a* at a desired interval to correspond to the first other-side rotating member 62*a* and is rotatably provided in a state of being offset from the first other-side rotating member 62*a* in a different direction, and a third other-side transmission member 62*c* which is interposed between the first other-side rotating member 62*a* and the second other-side rotating member 62*b* to correspond to the third one-side transmission member 61*c* and comes into contact with the other side of the paper sheet in a rotatable state in which one end and the other end are offset from each other.

The one-side redirecting member 61 or the other-side redirecting member 62 may be connected to a driving unit (not illustrated) to transmit the power thereto. The driving unit may be an electric motor capable of transmitting a rotating force or a gear capable of transmitting a rotating force from the exterior.

In the state in which the driving unit is connected to any one of the first one-side rotating member 61*a*, the second one-side rotating member 61*b*, the first other-side rotating member 62*a* and the second other-side rotating member 62*b*, when any one of the first one-side rotating member 61*a*, the second one-side rotating member 61*b*, the first other-side rotating member 62*a* and the second other-side rotating member 62*b* is rotated by the rotating force transmitted from the driving member, the third one-side transmission member 61*c* or the third other-side transmission member 62*c* can be rotated. Specifically, since the third one-side transmission member 61*c* and the third other-side transmission member 62*c* are brought into contact with each other, if one is rotated, the other is also rotated.

The first one-side rotating member 61*a* and the first other-side rotating member 62*a* respectively have rotational shafts 61*d* and 62*d* rotatably fixed to the housing 10, and non-slip portions 61*e* and 62*e* enclosing outer peripheral surfaces of the rotational shafts 61*d* and 62*d* to prevent slippage of the third one-side transmission member 61*c* or the third other-side transmission member 62*c*. Accordingly, since the rotational shafts 61*d* and 62*d* are rotated by the rotating force transmitted from the driving member, the third one-side transmission member 61*c* and the third other-side transmission member 62*c* can be rotated, without being slip, by the non-slip portions 61*e* and 62*e*. In this instance, the second one-side rotating member 61*b* and the second other-side rotating member 62*b* may be provided with a non-slip portion to prevent the slippage.

Figure 8:
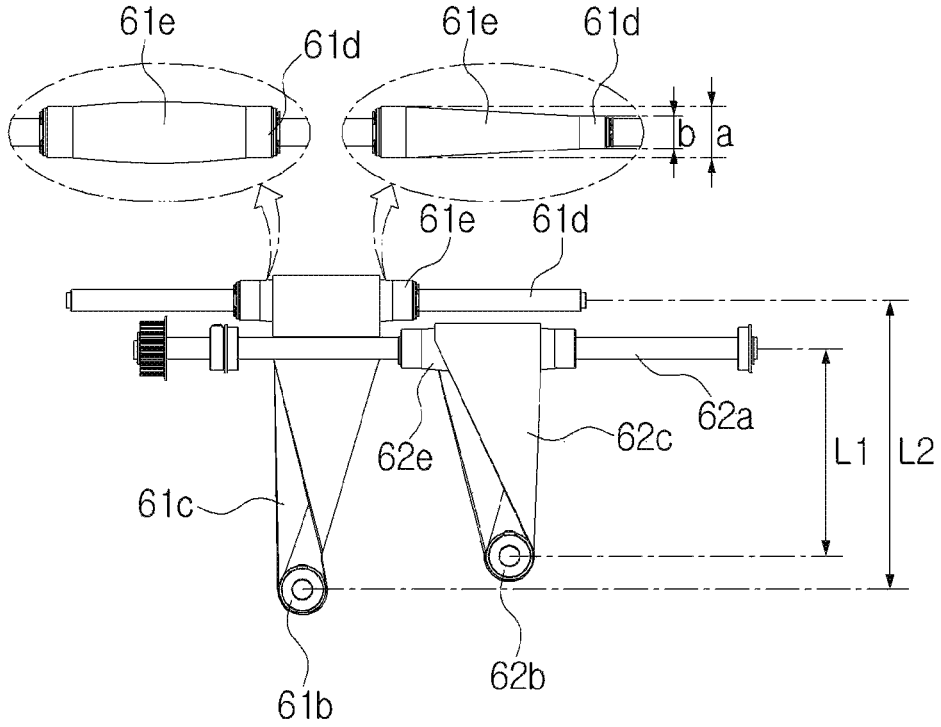
FIG. 8 is a front view illustrating an assembled state of the paper sheet redirecting unit.

As enlargedly illustrated in the left side in FIG. 8, the non-slip portions 61*e* and 62*e* may be made of rubber, plastic, or metal, and may have an outer peripheral surface with a center portion being bulged. The third one-side transmission member 61*c* and the third other-side transmission member 62*c* can be brought into contact with each other, so that the paper sheets can be easily transferred, without being slip.

As enlargedly illustrated in the right side in FIG. 8, the non-slip portions 61*e* and 62*e* may be formed in the shape of a cone. Specifically, a diameter b of one end may be larger than a diameter a of the other end. The third one-side transmission member 61*c* which is fixed to the first one-side rotating member 61*a* and the first other-side rotating member 62*a* in the cross state can be easily brought into contact with the non-slip portion 61*e* of the cone shape. Therefore, the third one-side transmission member 61*c* can be easily rotated, without being slip against the rotating non-slip portion 61*e*.

The first other-side rotating member 62*a* and the second other-side rotating member 62*b* may be rollers, and the third other-side transmission member 62*c* may be a belt. Specifically, if the power is transmitted to the first other-side rotating member 62*a* or the second other-side rotating member 62*b*, the third other-side transmission member 62*c* may be rotated.

The third one-side transmission member 61*c* and the third other-side transmission member 62*c* which are belts are preferably formed to be longer than a distance of the paper sheet. Accordingly, since the length of the belt is longer than the paper sheet, the other ends of the belts are brought into contact with each other in the case where the paper sheet is fed to one side of the belts. Both ends of the belts are brought into contact with each other even in the case where the paper sheet is positioned between the belts. One ends of the belts are brought into contact with each other in the case where the paper sheet is discharged from the other side of the belts. Of course, both sides of the paper sheet are brought into contact with the belts.

Therefore, the paper sheet fed between the third one-side transmission member 61*c* and the third other-side transmission member 62*c* which are rotated in the cross state can be discharged while the left and right sides are switched.

Explaining the operation in more detail, if the first one-side rotating member 61*a* of the one-side redirecting member 61 is rotated, the third one-side transmission member 61*c* which is brought into contact with one side of the paper sheet is rotated, with the third one-side transmission member 61*c* being interposed between the first one-side rotating member 61*a* and the second one-side rotating member 61*b*.

In this instance, the other-side redirecting member 62 operates with the one-side redirecting member 61, and the third other-side transmission member 62*c* is rotated in the state in which it is brought into contact with the other side of the paper sheet.

The first other-side rotating member 62*a* and the second other-side rotating member 62*b* which correspond to the first one-side rotating member 61*a* and the second one-side rotating member 61*b* are installed to the housing 10 in the state in which the first other-side rotating member 62*a* is perpendicular to the second other-side rotating member 62*b*. Accordingly, the third one-side transmission member 61*c* and the third other-side transmission member 62*c* are rotated in the cross state.

In this instance, the paper sheet can be transferred, while the left and right sides are switched by the third one-side transmission member 61*c* and the third other-side transmission member 62*c* which are rotated in the approximately cross state.

As the paper sheet facing downwardly by the first sorting member 50 is fed into the third one-side transmission member 61*c* and the third other-side transmission member 62*c*, a moving direction of the paper sheet is switched to face downwardly. The left and right sides of the paper sheet moving downwardly by the third one-side transmission member 61*c* and the third other-side transmission member 62*c* which are rotated in the cross state are switched. Specifically, after the left and right sides of the paper sheet are switched, the paper sheet is fed to the upper portion of the second sorting member 70 which will be described later.

As illustrated in FIG. 8, the third one-side transmission member 61*c* and the third other-side transmission member 62*c* are formed to have a different length. Specifically, if the third other-side transmission member 62*c* is shorter than the third one-side transmission member 61*c*, a spaced length L2 between the first other-side rotating member 62*a* and the third other-side transmission member 62*c* is shorter than a spaced length L1 between the first one-side rotating member 61*a* and the second one-side rotating member 61*b*.

Since the first other-side rotating member 62*a* and the second other-side rotating member 62*b* of the other-side redirecting member 62 do not interfere with the first one-side rotating member 61*a* and the second one-side rotating member 61*b* of the one-side redirecting member 61, the third other-side transmission member 62*c* of the shorter length is easily brought into contact with the third one-side transmission member 61*c* having the relatively long length.

If the third one-side transmission member 61*c* and the third other-side transmission member 62*c* are rotated in the contact state, the frictional force on both sides of the paper sheet is increased, so that the paper sheet is easily transferred.

Figure 9:
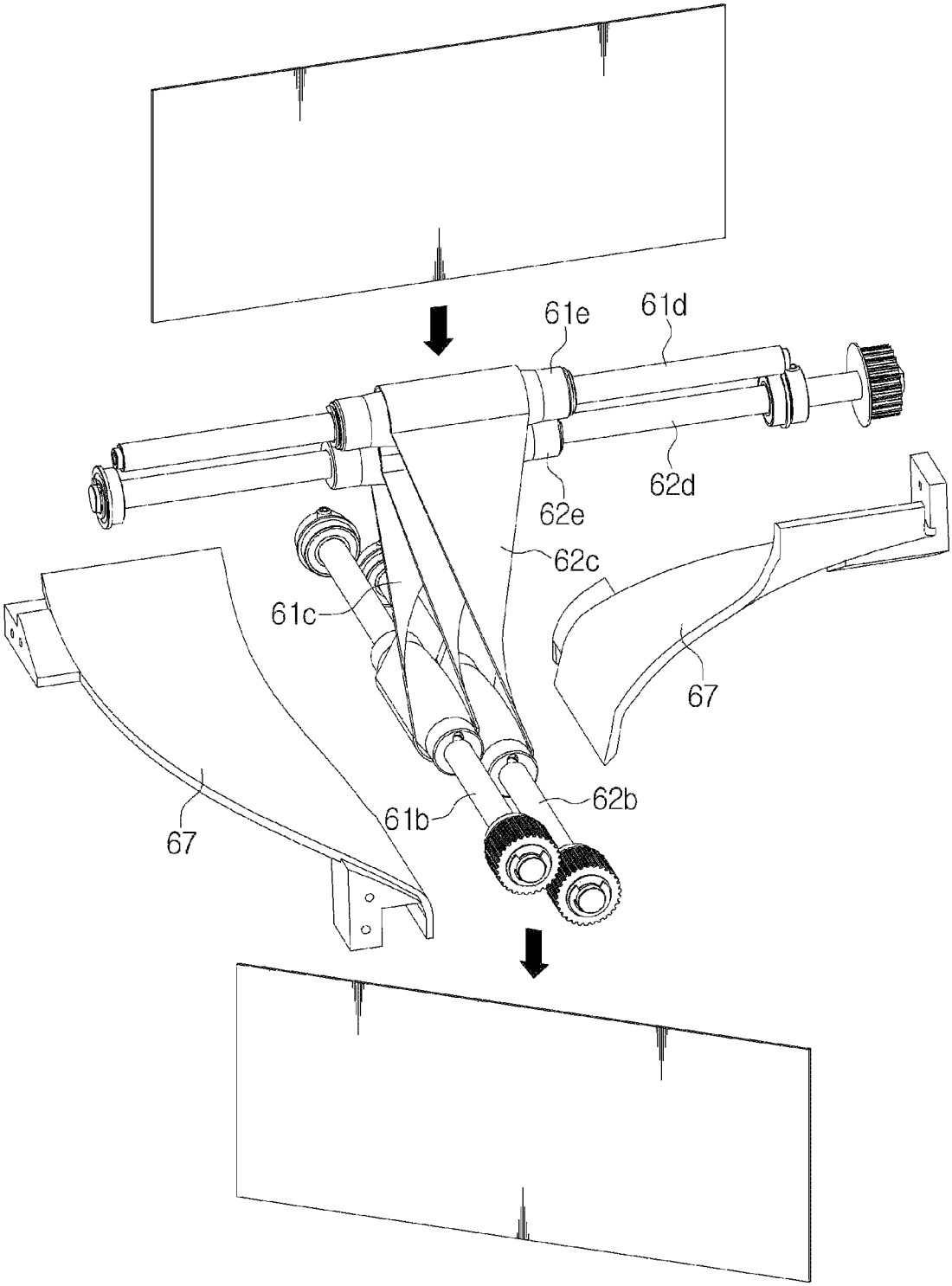
FIG. 9 is a perspective view illustrating a state of redirecting a paper sheet by the paper sheet redirecting unit.
Figure 11:
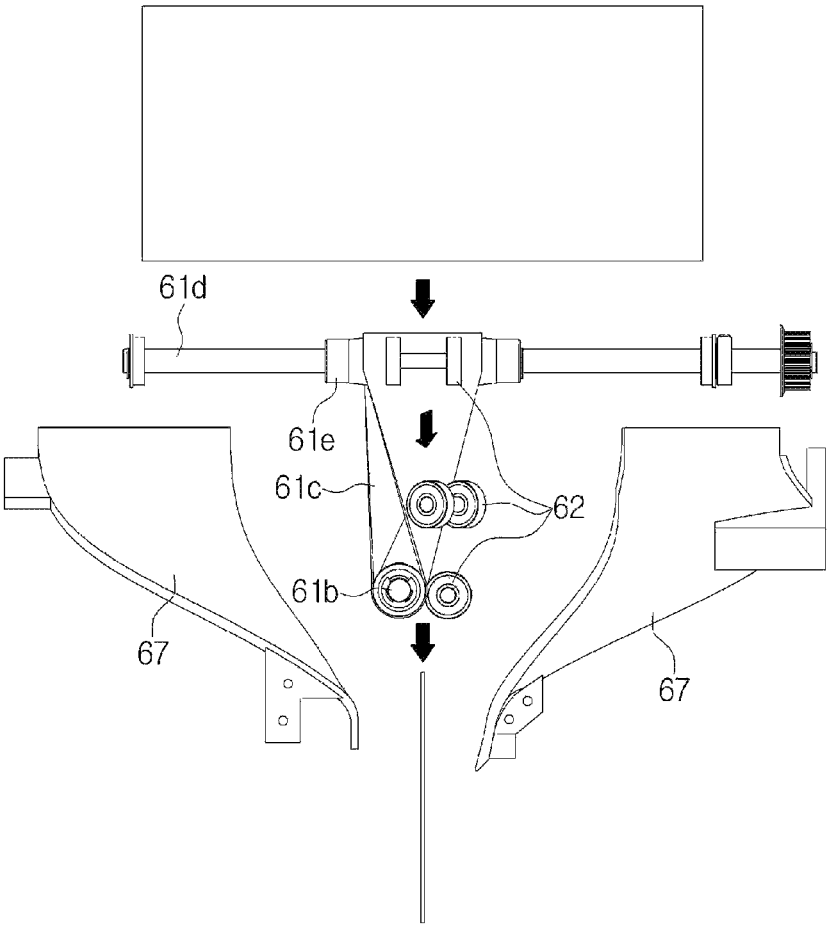
FIG. 11 is a front view illustrating a state of redirecting a paper sheet by the paper sheet redirecting unit in FIG. 10.

As illustrated in FIGS. 9 and 11, the paper sheet redirecting unit 60 has a redirecting guide 67 to guide the paper sheet which is redirected by the one-side redirecting member 61 and the other-side redirecting member 62. The redirecting guide 67 may be made of a plate of which one surface is twisted from one end to the other end. The twisted plates are provided to both sides of the paper sheet redirecting unit 60 to guide both sides of the redirecting paper sheet.

Since the redirecting guides 67 are respectively provided to the one-side redirecting member 61 and other-side redirecting member 62, both sides of the paper sheet redirected by the one-side redirecting member 61 and the other-side redirecting member 62 are supported and guided, thereby preventing the paper sheet from wrinkling or folding in the process of redirecting the paper sheet. Therefore, the paper sheet can be redirected in the state in which it fully spreads.

Figure 10:
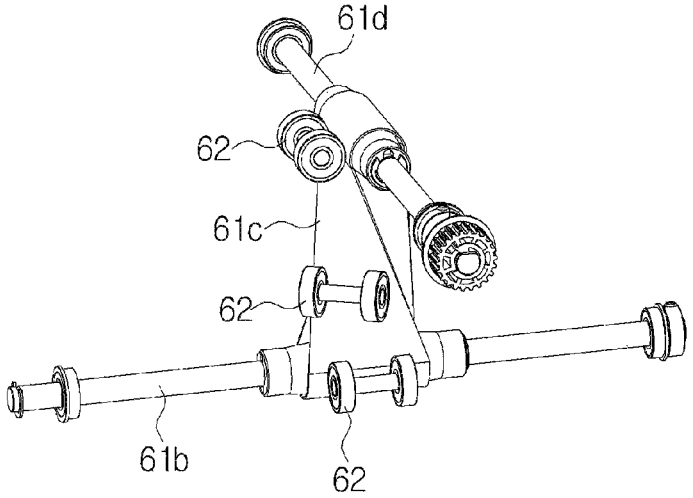
FIG. 10 is a perspective view illustrating a paper sheet redirecting unit according to another embodiment of the present invention.

As illustrated in FIGS. 10 and 11, the paper sheet redirecting unit 60 has the one-side redirecting member 61 and an other-side redirecting member 62 which is different from the above other-side redirecting member 62.

Since the one-side redirecting member 61 is substantially identical to the above-described one-side redirecting member 61, the detailed description will be omitted herein.

The other-side redirecting member 62 consists of a plurality of guide rollers which are brought into contact with the outer peripheral surface of the third one-side transmission member 61*c* and are rotated by the rotation of the third one-side transmission member 61*c*.

The guide rollers are installed to the housing 10 to guide the transport of the paper sheet in such a way that the guide rollers are able to idle in the state in which the guide rollers are separated at upper, lower and middle portions of the third one-side transmission member 61*c*.

In addition, since the guide rollers are driven gears of a simple structure, and are respectively installed to the housing 10, it is possible to easily and conveniently carry out mounting and demounting work.

As described above, the paper sheet horizontally transferred is redirected in a vertical direction by the paper sheet redirecting unit 60, and then is guided to the downward direction, so that the paper sheet can be sorted to the left or right side of the housing 10 by the second sorting member 70 which will be described later.

Figure 12:
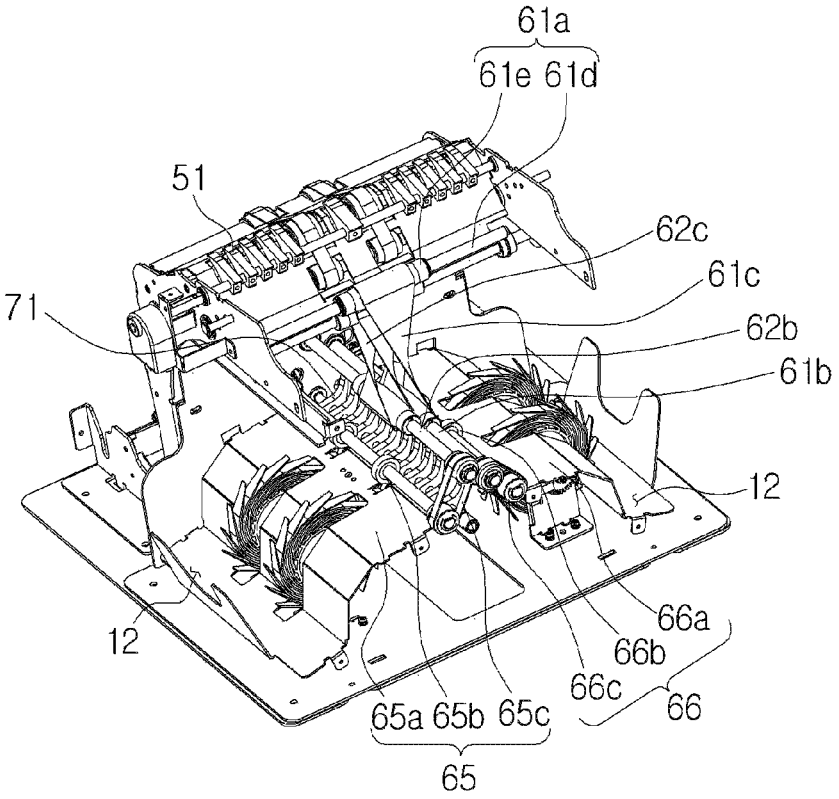
FIG. 12 is a perspective view illustrating the paper sheet processing apparatus equipped with the paper sheet redirecting unit.
Figure 13:
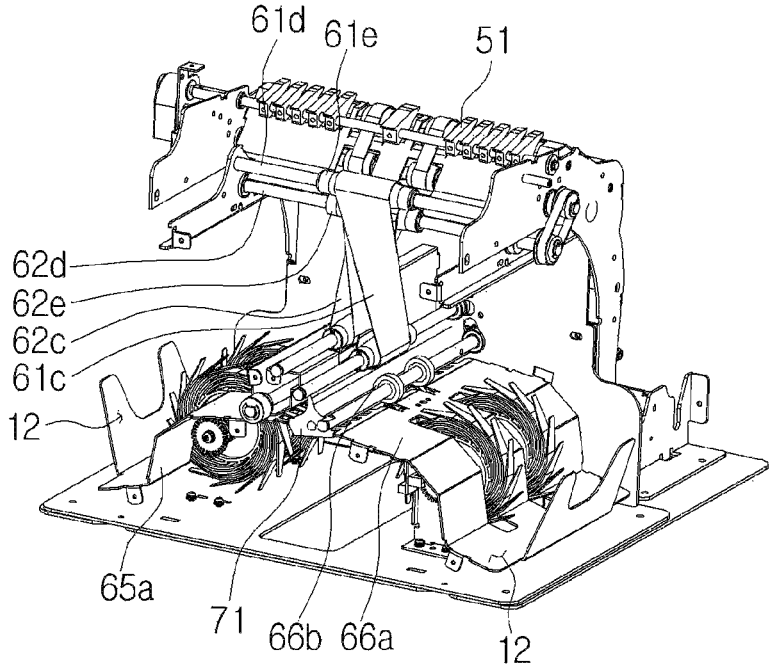
FIG. 13 is a perspective view of the paper sheet processing apparatus when seen in a different direction.
Figure 14:
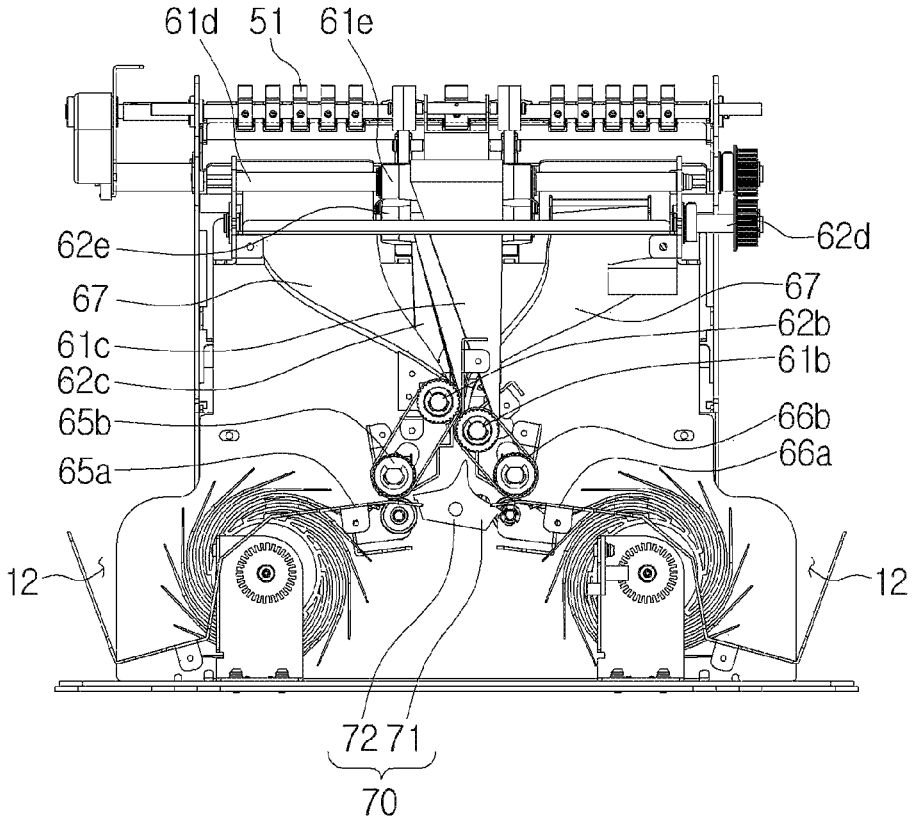
FIG. 14 is a front view of the paper sheet processing apparatus in FIG. 12.

As illustrated in FIGS. 12 to 14, the paper sheet redirecting unit 60 has a one-side transport member 65 which is rotated by the rotating force of the one-side redirecting member 61 to transfer the paper sheet transferred by the third one-side transmission member 61*c* and the third other-side transmission member 62*c* to the discharge hopper 12 provided to one side of the housing 10, and an other-side transport member 66 which is rotated by the rotating force of the other-side redirecting member 62 to transfer the paper sheet transferred by the third one-side transmission member 61*c* and the third other-side transmission member 62*c* to the discharge hopper 12 provided to the other side of the housing 10.

The one-side transport member 65 has a one-side guide plate 65*a* facing the discharge hopper 12 provided to one side of the housing 10, a one-side rotating portion 65*b* which is rotatably installed to the housing 10 in a state of being adjacent to the one-side guide plate 65*a* to transfer the paper sheet to the discharge hopper 12 provided to one side of the housing 10, and a one-side transmission portion 65*c* which is interposed between the one-side rotating portion 65*b* and the one-side redirecting member 61 to transmit the power from the other-side redirecting member 62 to the one-side rotating portion 65*b*.

The one-side guide plate 65*a* may be formed to have a top flat surface so that the paper sheet is able to slide thereon.

The one-side rotating portion 65*b* may be a roller with a roller shaft protruding toward both sides. In this instance, the one-side rotating portion 65*b* is spaced apart from the one-side guide plate 65*a*. Therefore, the one-side rotating portion 65*b* can prevent the paper sheet guided by the one-side guide plate 65*a* from floating and leaving outside.

The one-side transmission portion 65*c* may be a belt interposed between the roller shaft of the one-side rotating portion 65*b* and the second one-side rotating member 61*b* of the one-side redirecting member 61. Alternatively, the one-side transmission portion 65*c* may be a pinion which is simultaneously meshed with a gear provided on the roller shaft of the one-side rotating portion 65*b* and a gear provide don the one-side redirecting member 61.

The one-side rotating portion 65*b* rotates with other roller which is adjacent to the one-side guide plate 65*a*, to transfer the paper sheet to the one-side guide plate 65*a*. Also, the one-side rotating portion 65*b* may be positioned adjacent to the one-side guide plate 65*a* to slide and transfer the paper sheet to the one-side guide plate 65*a*.

If the one-side redirecting member 61 rotates, the one-side transmission portion 65*c* is driven to rotate the one-side rotating portion 65*b*, and thus the paper sheet is slid on the one-side guide plate 65*a* by the rotation of the one-side rotating portion 65*b*, so that the paper sheet is transferred to the discharge hopper 12 provided to one side of the housing 10.

The other-side transport member 66 has an other-side guide plate 66*a* facing the discharge hopper 12 provided to the other side of the housing 10, an other-side rotating portion 66*b* which is rotatably installed to the housing 10 in a state of being adjacent to the other-side guide plate 66*a* to transfer the paper sheet to the discharge hopper 12 provided to the other side of the housing 10, and an other-side transmission portion 66*c* which is interposed between the other-side rotating portion 66*b* and the other-side redirecting member 62 to transmit the power from the other-side redirecting member 62 to the other-side rotating portion 66*b*.

The other-side rotating portion 66*b* may be a roller, and the other-side transmission portion 66*c* may be a belt interposed between the one-side rotating portion 65*b* and the second one-side rotating member 61*b* of the one-side redirecting member 61.

The other-side transport member 66 is provided to be symmetrical to the one-side transport member 65, thereby transfer the paper sheet to the discharge hopper 12 provided to the other side of the housing 10.

The one-side transport member 65 and the other-side transport member 66 are provided to the middle portion of the housing 10 in a symmetrical relation to respectively transfer the paper sheet sorted by the second sorting member 70, which will be described, to the discharge hoppers 12 provided to both sides of the housing 10.

The second sorting member 70 is provided to one side of the paper sheet redirecting unit 60, and is operated according to the discrimination of the sensing member 40 to sort the paper sheets transferred by the paper sheet redirecting unit 60 so that the paper sheets are respectively sorted to the discharge hoppers 12 provided to both sides of the housing 10. The second sorting member 70 has a second sorter 71 and a second sorter driving member 72.

Since the second sorter 71 and the second sorter driving member 72 are substantially identical to the above-described first sorter 51 and the first sorter driving member 52, its detailed description will be omitted herein.

The second sorter 71 is rotatably installed to the housing 10 in such a way that it faces upwardly from the lower portion of the paper sheet redirecting unit 60. The second sorter 71 turns to the right or the left by operation of the second sorter driving member 72.

Accordingly, if a sharp end of the second sorter 71 faces the left by operation of the second sorter 71 and then the second sorter 71 is fixed in an inclined state, the paper sheet to be discharged from the paper sheet redirecting unit 60 is guided to the other side along the guide surface. If the second sorter 71 rotates in the counterclockwise direction and thus the sharp end of the second sorter 71 faces the right, the paper sheet to be discharged from the paper sheet redirecting unit 60 is guided to the left side along the other guide surface. Specifically, as the second sorter 71 rotates in both directions, the sorted paper sheets can be respectively guided to the discharge hoppers 12 provided to both sides of the housing 10.

The operation of the present invention will now be described.

First, if the paper sheet is fed through the inlet hopper 11 of the housing 10, the paper sheet is fed to the transport member 30 by the feeding member 20. The transport member 30 transfers the paper sheet to the inner space of the housing 10.

The sensing member 40 detects the counterfeit bill, the type or the damaged banknote among the paper sheets transferred. A counting sensor 80 counts the number of the paper sheets transferred by the transport member 30.

The first sorting member 50 transfers the paper sheet transferred by the transport member 30 toward the discharge hoppers 12 provided to the front side of the housing 10 or the lower portion of the housing 10.

The paper sheet sorted by the first sorting member 50 is discharged to the discharge hopper 12 provided to the front side of the housing 10, and the remaining paper sheets are sorted by the first sorting member 50 and then are moved to the lower portion of the housing 10 and then the paper sheet redirecting unit 60.

The paper sheet redirecting unit 60 drags the paper sheets down so that the front end of the paper sheet to be fed, in the state in which both ends look at the both sides of the housing 10, faces downwardly, and then in the state both ends of the paper sheet, and then transfers the paper sheet to the lower portion of the housing while redirecting both ends of the paper sheet toward the front and back of the housing 10. In this instance, the paper sheet to be redirected may be fed to the upper portion of the second sorting member 70 in a vertical state.

The second sorting member 70 sorts the paper sheet transferred toward the left side or the right side. Specifically, the paper sheet to be sorted is respectively discharged to the discharge hoppers 12 provided to the left side and the right side of the housing 10.

As described above, since the direction of the paper sheet is switched from the horizontal state to the vertical state by the paper sheet redirecting unit 60, the left and right directions of the paper sheet is switched to the forward and rearward directions, which can be correctly sorted to the left and right sides by the second sorting member 70.

Also, if the number of the paper sheets or the type of the paper sheet is set by a controller 90, the paper sheets which are sorted by the set number or by the set type can be discharged to the respective discharge hoppers 12.

As described above, since the present invention is configured to discharge the paper sheets to the front side or both sides of the housing, the whole volume thereof can be minimized, and it is possible to dust coming from the paper sheet to be discharged from being dispersed in front of the housing.

Figure 15:
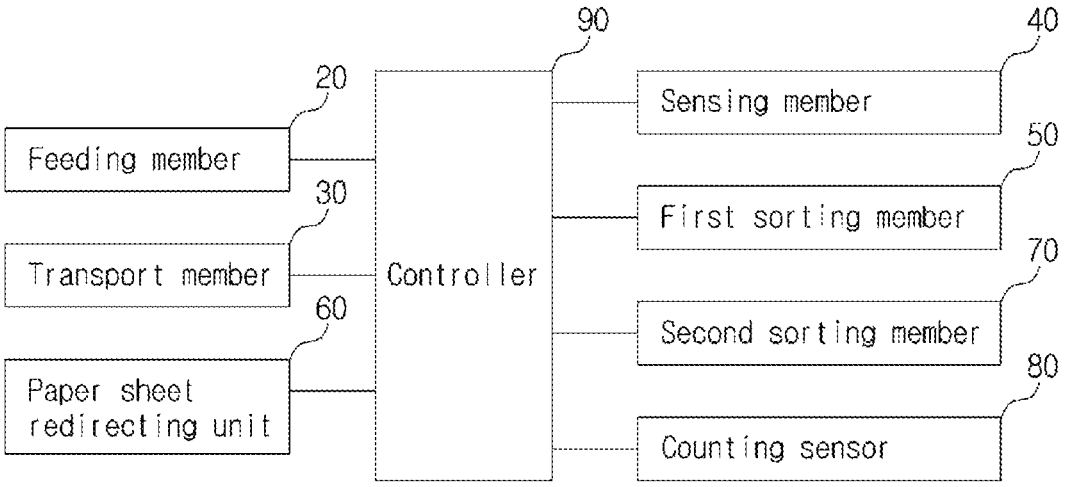
FIG. 15 is a block diagram illustrating a configuration of the present invention.
Figure 16:
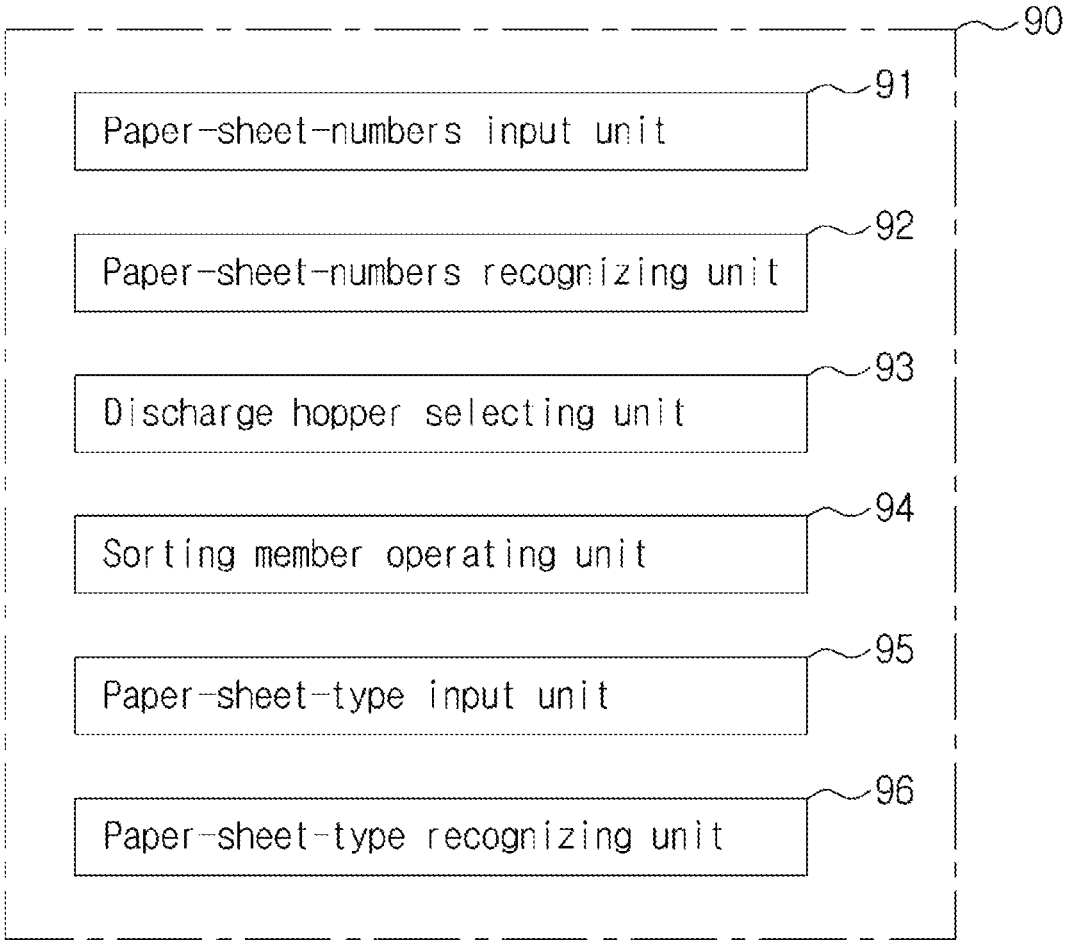
FIG. 16 is a block diagram illustrating a configuration of a controller applied to the present invention.

As illustrated in FIGS. 15 and 16, the present invention includes the counting sensor 80 which is provided to one side of the transport member 30 to count the number of paper sheets to be transferred by the transport member 30, and the controller 90 to recognize the paper sheets to be counted by the counting sensor 80 and control the first sorting member 50 and the second sorting member 70 according to the discrimination of the sensing member 40.

The counting sensor 80 can count the number of paper sheets to be transferred by the transport member 30.

The controller 90 can control the first sorting member 50 and the second sorting member 70 according to the discrimination of the sensing member 40, and can recognize the number of paper sheets to be counted by the counting sensor 80. Also, the controller can be configured to control the feeding member 20, the transport member 30, and the paper sheet redirecting unit 60. The controller 90 may be a circuit board equipped with programmable IC chips and electronic components.

The controller 90 has a paper-sheet-numbers input unit 91 for inputting the number of paper sheets, a paper-sheet-numbers recognizing unit 92 which corresponds to the number of paper sheets inputted by the paper-sheet-numbers input unit 91, by the counting sensor 80, a discharge hopper selecting unit 93 for selecting the discharge hopper of the housing 10, and a sorting member operating unit 94 for operating the first sorting member 50 and the second sorting member 70 to sort the paper sheets by the input number and to discharge the paper sheet to the discharge hopper 12 of the housing 10 which is selected by the discharge hopper selecting unit 93, if the number of paper sheets inputted by the paper-sheet-numbers input unit 91 is identical to the number of paper sheets recognized by the paper-sheet-numbers recognizing unit 92.

For example, if 10, 20 and 70 paper sheets are inputted by the paper-sheet-numbers input unit 91, and the discharge hopper 12 provided to the front side of the housing 10, the discharge hopper 12 provided to one side of the housing 10, and the discharge hopper 12 provided to the other side of the housing 10 are selected by the discharge hopper selecting unit 93, the sorting member operating unit 94 operates the first sorting member 50 and the second sorting member 70, so that 10 paper sheets are discharged to the discharge hopper 12 provided to the front side of the housing 10, 20 paper sheets are discharged to the discharge hopper 12 provided to one side of the housing 10, and 70 paper sheets are discharged to the discharge hopper 12 provided to the other side of the housing 10.

Also, the controller 90 has a paper-sheet-type input unit 95 to input the type of paper sheet, and a paper-sheet-type recognizing unit 96 to recognize the paper sheet corresponding to the type of paper sheets inputted in the controller by the paper-sheet-type input unit 95 through the sensing member 40. The sorting member operating unit 94 can be set to operate the first sorting member 50 and the second sorting member 70 so that the paper sheets recognized by the paper-sheet-type recognizing unit 96 are sorted by type and transferred to the discharge hoppers 12 selected by the discharge hopper selecting unit 93.

The paper-sheet-type input unit 95 can input any one of the counterfeit bill, the type and the damaged banknote which are types of paper sheets in the controller.

For example, if the types of paper sheets are inputted as a 1000-won bill, a 5000-won bill and a 10000-won bill by the paper-sheet-type input unit 95, and the discharge hopper selecting unit 93 selects the discharge hopper 12 provided to the front side of the housing 10, the discharge hopper 12 provided to one side of the housing 10, and the discharge hopper 12 provided to the other side of the housing 10, 1000-won paper sheets are discharged to the discharge hopper 12 provided to the front side of the housing 10, 5000-won paper sheets are discharged to the discharge hopper 12 provided to one side of the housing 10, and 10000-won paper sheets are discharged to the discharge hopper 12 provided to the other side of the housing 10.

The controller 90 can stop the operation of the feeding member 20 if the sorting member operating unit 94 recognizes the fact in that the paper sheets sorted by type are sorted by the input number and then are respectively discharged. Accordingly, if the paper sheets are discharged to the discharge hopper 12 by the input number, the feeding member 20 is stopped, thereby preventing the sorted paper sheets from being mixed with other paper sheets.

As described above, since the present invention is configured to discharge the paper sheets to the front side or both sides of the housing, the whole volume thereof can be minimized, and it is possible to dust coming from the paper sheet to be discharged from being dispersed in front of the housing. Therefore, the present invention is very useful to be applied to a paper sheet processing unit, such as a paper sheet ATM or a paper sheet counter.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A paper sheet redirecting unit (60) for changing a direction of a paper sheet to be transferred, the paper sheet redirecting unit comprising:

a one-side redirecting member (61) configured to support one side of the paper sheet and change the direction of the paper sheet while transferring the paper sheet with the one-side redirecting member (61) including a first one-side rotating member (61*a*) rotatably provided;

a second one-side rotating member (61*b*) which is spaced apart from the one-side redirecting member (61) at a desired interval and is rotatably provided in a state of being offset from the first one-side rotating member (61*a*) in a different direction;

a third one-side rotating member (61*c*) which is rotatably interposed between the first one-side rotating member (61*a*) and the second one-side rotating member (61*b*) and comes into contact with one side of the paper sheet in a state in which one end and the other end are offset from each other;

an other-side redirecting member (62) configured to support other side of the paper sheet in a state of coming in contact with the one-side redirecting member (61) and to change the direction of the paper sheet while transferring the paper sheet with the other-side redirecting member (62) including a first other-side rotating member (62*a*) which is rotatably provided to correspond to the first one-side rotating member (61*a*);

a second other-side rotating member (62*b*) which is spaced apart from the first other-side rotating member (62*a*) at a desired interval to correspond to the first other-side rotating member (62*a*) and is rotatably provided in a state of being offset from the first other-side rotating member (62*a*) in a different direction; and a third other-side transmission member (62*c*) which is rotatably interposed between the first other-side rotating member (62*a*) and the second other-side rotating member (62*b*) to correspond to the third one-side transmission member (61*c*) and comes into contact with the other side of the paper sheet in a rotatable state in which one end and the other end are offset from each other, wherein if a power is transmitted to the one-side redirecting member (61) or the other-side redirecting member (62), the one-side redirecting member (61), and the other-side redirecting member (62) are operated in company with each other, thereby discharging the paper sheet while changing the direction of the paper sheet to be inputted between the one-side redirecting member (61) and the other-side redirecting member (62), wherein the first one-side rotating member (61*a*) and the first other-side rotating member (62*a*) respectively have rotational shafts (61*d* and 62*d*) rotatably fixed to the housing (10), and non-slip portions (61*e* and 62*e*) enclosing outer peripheral surfaces of the rotational shafts (61*d* and 62*d*) to prevent slippage of the third one-side transmission member (61*c*) or the third other-side transmission member (62*c*), and wherein the non-slip portions (61*e* and 62*e*) are formed in a cylindrical shape in such a way that an outer peripheral surface thereof has bulged, or are formed in a conical shape.

2. The paper sheet redirecting unit (60) according to claim 1, wherein the third one-side transmission member (61*c*) and the third other-side transmission member (62*c*) are formed to be longer than a distance of the paper sheet.

3. The paper sheet redirecting unit (60) according to claim 1, wherein the third one-side transmission member (61*c*) and the third other-side transmission member (62*c*) are respectively formed to have a different length.

4. The paper sheet redirecting unit (60) according to claim 1, wherein the paper sheet redirecting unit (60) has a redirecting guide (67) to guide the paper sheet which is redirected by the one-side redirecting member (61) and the other-side redirecting member (62).

5. The paper sheet redirecting unit (60) according to claim 4, wherein the redirecting guide (67) is made of a plate of which one surface is twisted from one end to the other end.

6. The paper sheet redirecting unit (60) according to claim 1, further comprising a one-side transport member (65) which is rotated by a rotating force of the one-side redirecting member (61) to transfer the paper sheet to one side of the housing, and an other-side transport member (66) which is rotated by a rotating force of the other-side redirecting member (62) to transfer the paper sheet to the other side of the housing.

7. The paper sheet redirecting unit (60) according to claim 6, wherein the one-side member (65) has a one-side guide plate (65*a*) configured to guide the paper sheet discharged by the one-side redirecting member (61) and the other-side redirecting member (62) to one side, a one-side rotating portion (65*b*) configured to transfer the paper sheet along the one-side guide plate (65*a*), while the one-side rotating portion is rotated in a state of being spaced apart from the one-side guide plate (65*a*), and a one-side transmission portion (65*c*) configured to transmit the rotating force from the one-side redirecting member (61) to the one-side rotating portion (65*b*).

8. The paper sheet redirecting unit (60) according to claim 6, wherein the other-side transport member (66) has an other-side guide plate (66*a*) configured to guide the paper sheet discharged by the one-side redirecting member (61) and the other-side redirecting member (62) to other side, an other-side rotating portion (66*b*) configured to transfer the paper sheet along the other-side guide plate (66*a*), while the one-side rotating portion is rotated in a state of being spaced apart from the other-side guide plate (66*a*), and an other-side transmission portion (66*c*) configured to transmit the rotating force from the other-side redirecting member (62) to the other-side rotating portion (66*b*).

9. A paper sheet processing apparatus comprising:

a housing (10) equipped with the paper sheet redirecting unit (60) set forth in claim 1;

a sensing member (40) configured to detect a paper sheet fed into an inner space of the housing (10); and a first sorting member (50) configured to sort the paper sheet so that the paper sheet detected by the sensing member (40) is guided to a paper sheet redirecting unit (60) or in a direction from paper sheet redirecting unit (60).

10. The paper sheet processing apparatus according to claim 9, wherein the housing (10) includes discharge hoppers (12) through which the paper sheet is guided to an outside of the paper sheet redirecting unit (60), or the paper sheet passing the paper sheet redirecting unit 60) is discharged.

11. The paper sheet processing apparatus according to claim 10, wherein the discharge hoppers (12) are respectively provided to both sides of the housing, or are separately provided to one side and both sides of the housing (10).

12. The paper sheet processing apparatus according to claim 9, further comprising a second sorting member (70) configured to sort the paper sheet to be discharged by the paper sheet redirection unit (60) according to discrimination of the sensing member (40), and to guide the paper sheet in different directions.

* * * * *